US011933290B2

(12) United States Patent
Bakken et al.

(10) Patent No.: US 11,933,290 B2
(45) Date of Patent: Mar. 19, 2024

(54) AXIAL PISTON PUMP CONTROLLER

(71) Applicant: Caterpillar Inc., Peoria, IL (US)

(72) Inventors: Arick Bakken, Broughton Astley (GB); Paul John Cairns, Groby (GB); William Christopher Swick, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 1 day.

(21) Appl. No.: 17/886,693

(22) Filed: Aug. 12, 2022

(65) Prior Publication Data

US 2023/0052785 A1 Feb. 16, 2023

(30) Foreign Application Priority Data

Aug. 12, 2021 (GB) ..... 2111611

(51) Int. Cl.
*F04B 1/324* (2020.01)
*F04B 1/146* (2020.01)
(Continued)

(52) U.S. Cl.
CPC ..... *F04B 49/065* (2013.01); *F04B 1/146* (2013.01); *F04B 1/188* (2013.01); *F04B 1/324* (2013.01);
(Continued)

(58) Field of Classification Search
CPC ..... F04B 49/065; F04B 1/324; F04B 2203/0201; F04B 2203/0209; F04B 2205/05
See application file for complete search history.

(56) References Cited

U.S. PATENT DOCUMENTS 6,073,442 A 6/2000 Creger
6,442,934 B1 * 9/2002 Okuda ..... F16H 61/46 60/451
(Continued)

FOREIGN PATENT DOCUMENTS

CN 105134396 B 6/2018
JP H0828455 A 1/1996
(Continued)

OTHER PUBLICATIONS

Great Britain Search Report related to Application No. 2111611.6 reported on Jan. 19, 2022.

*Primary Examiner* — Thomas Fink

(57) ABSTRACT

An axial piston pump controller for an axial piston pump having a fixed valve plate and a variable displacement is provided. The axial piston pump controller is configured to determine a displacement of the axial piston pump, and to calculate a pump displacement control current to be supplied to the axial piston pump to control the displacement of the axial piston pump. Calculating the pump displacement control current comprises calculating a nominal value for the pump displacement control current based on a rotational speed of the axial piston pump, calculating a pump stiffness adjustment factor based on a pump stiffness control map having as inputs: an output pressure of the axial piston pump; and the estimated pump displacement, and calculating the pump displacement control current to be supplied to the axial piston pump based on the nominal value and the pump stiffness adjustment factor. The controller is further configured to output an instruction to output the calculated pump displacement control current to the axial piston pump in order to control the displacement of the axial piston pump.

15 Claims, 7 Drawing Sheets

(51) Int. Cl.
*F04B 1/188* (2020.01)
*F04B 49/06* (2006.01)
*F04B 49/12* (2006.01)

(52) U.S. Cl.
CPC ..... *F04B 49/12* (2013.01); *F04B 2201/0201* (2013.01); *F04B 2203/0201* (2013.01); *F04B 2203/0209* (2013.01); *F04B 2205/05* (2013.01)

(56) References Cited

U.S. PATENT DOCUMENTS

| | | | | |
|---|---|---|---|---|
| 9,211,808 | B2 | 12/2015 | Young | |
| 9,759,212 | B2 * | 9/2017 | Lingenfelter | F04B 1/324 |
| 9,777,750 | B2 | 10/2017 | Sugano | |
| 9,869,311 | B2 | 1/2018 | Du | |
| 11,644,027 | B2 * | 5/2023 | Ligenfelter | F04B 1/324 417/222.1 |
| 11,808,258 | B2 * | 11/2023 | Shimamoto | F04B 51/00 |
| 2014/0169987 | A1 | 6/2014 | Du | |
| 2016/0341193 | A1 | 11/2016 | Du et al. | |
| 2018/0291889 | A1 | 10/2018 | Farr et al. | |

FOREIGN PATENT DOCUMENTS

| | | | |
|---|---|---|---|
| WO | 2009110498 | A1 | 9/2009 |
| WO | 2020195299 | | 10/2020 |

* cited by examiner

| 1000 rpm | | Drive Pressure (bar) | | | | | |
|---|---|---|---|---|---|---|---|
| | | 0 | 100 | 200 | 300 | 400 | 500 |
| Absolute Percentage of Pump Dspl (%) | 0 | 0 | 0 | 50 | 75 | 100 | 125 |
| | 25 | 0 | 0 | 25 | 50 | 75 | 100 |
| | 50 | 0 | 0 | 0 | 25 | 50 | 75 |
| | 75 | 0 | 0 | 0 | 0 | 25 | 50 |
| | 100 | 0 | 0 | 0 | 0 | 0 | 25 |

| 1500 rpm | | Drive Pressure (bar) | | | | | |
|---|---|---|---|---|---|---|---|
| | | 0 | 100 | 200 | 300 | 400 | 500 |
| Absolute Percentage of Pump Dspl (%) | 0 | 0 | 0 | 52.5 | 78.75 | 105 | 131.25 |
| | 25 | 0 | 0 | 26.25 | 52.5 | 78.75 | 105 |
| | 50 | 0 | 0 | 0 | 26.25 | 52.5 | 78.75 |
| | 75 | 0 | 0 | 0 | 0 | 26.25 | 52.5 |
| | 100 | 0 | 0 | 0 | 0 | 0 | 26.25 |

AXIAL PISTON PUMP CONTROLLER

CROSS-REFERENCE TO RELATED APPLICATION

This application claims priority under 35 U.S.C. § 119 and the Paris Convention to Great Britain Patent Application No. 2111611.6 filed on Aug. 12, 2021.

FIELD OF THE DISCLOSURE

The present disclosure relates to axial piston pumps. In particular, the present disclosure relates to the control of an axial piston pump.

BACKGROUND

An axial piston pump generally comprises a plurality of pistons arranged within a cylinder block. The cylinder block may be driven to rotate about its axis by a shaft, which is typically connected to an internal combustion engine, or other mechanical drive means.

A diagram of an axial piston pump known in the art is shown in FIG. 1. The axial piston pump comprises a plurality of pistons 12 which are located in a circular array within a piston barrel 3. The pistons 12 are rotated around a longitudinal axis by rotational shaft 8 which is located at a longitudinal centre of the piston barrel 3.

Each piston 12 is connected to the swash plate 11 via a connector, typically a ball and socket joint. The swash plate 11 is moveable about a pivot point such that the angle of inclination of the swash plate 11 can be varied. In FIG. 1, the angle of inclination of the swashplate is 0° such that the axial piston pump has zero displacement. The angle of inclination of the swash plate 11 is controlled by some form of actuator, for example a servo piston 2.

The pistons 12 within the piston barrel 3 are arranged to bear against a swashplate.

The variable displacement of the cylinders within the piston barrel 3 is typically provided by variation in an angle of a swash plate. The angle of the swash plate may be controlled by a solenoid valve, which in turn controls the displacement of the cylinders.

As the piston barrel 3 rotates, the pistons reciprocate within the piston barrel 3. A valve plate provided on the opposite end of the piston barrel 3 to the swashplate defines an at least one inlet 40 and at least one outlet 42 for fluid being pumped through the axial piston pump.

In some known axial piston pumps, the rotational position of the valve plate inlets 40 and outlets 42 may be adjusted by providing an adjustable valve plate. An example of the adjustment of an adjustable valve plate using timing screws 30, 31 is shown in FIG. 2. As shown in FIG. 2, the timing screws 30, 31 may be used to rotate the position of each of the valve plate inlets 40 and outlets 42 about an axis at the centre of the adjustable valve pate. Such adjustments to the rotational position of the adjustable valve plate affects the timing of the pump, that is the point within the rotational cycle of the pistons where hydraulic fluid is being drawn into the pistons, and also the point at which hydraulic fluid is being expelled from the pistons.

The change in timing brought by adjustment of an adjustable valve plate in turn affects the "stiffness" of the axial piston pump. The stiffness of the axial piston pump reflects the relationship between the pump displacement and the output pressure. Axial piston pumps with increased stiffness require a greater pressure to destroke the pump. By adjusting the timing of an axial piston pump (via an adjustable valve plate) the stiffness of the axial piston pump can be calibrated mechanically.

Against this background, the present disclosure aims to provide an improved, or at least commercially relevant alternative axial piston pump or axial piston pump controller.

SUMMARY

According to a first aspect of the disclosure an axial piston pump controller for an axial piston pump having a fixed valve plate and a variable displacement is provided. The axial piston pump controller is configured to:

- determine a displacement of the axial piston pump;
- calculate a pump displacement control current to be supplied to the axial piston pump to control the displacement of the axial piston pump comprising:
  - calculating a nominal value for the pump displacement control current based on a rotational speed of the axial piston pump;
  - calculating a pump stiffness adjustment factor based on a pump stiffness control map having as inputs: an output pressure of the axial piston pump; and the estimated pump displacement; and
  - calculating the pump displacement control current to be supplied to the axial piston pump based on the nominal value and the pump stiffness adjustment factor; and
- output an instruction to output the calculated pump displacement control current to the axial piston pump in order to control the displacement of the axial piston pump.

The controller of the first aspect is configured to control an axial piston pump having a fixed valve plate. The controller of the first aspect calculates a pump stiffness adjustment factor which is used to modify the nominal value for the pump displacement current determined based on the pump rotational speed. In effect, the pump stiffness adjustment factor can increase or decrease the stiffness by increasing or decreasing the pump displacement control current output with respect to the nominal value calculated based on the pump rotational speed. Thus, rather than determining the pump displacement control current using a one dimensional control map based on engine speed, the controller of the first aspect uses a three dimensional control strategy (pump rotational speed, pump output pressure, and pump displacement). The effect of changing the stiffness of the axial piston pump is similar to the effect achieved by adjusting the timing of the pump based on the position of an adjustable valve plate. Accordingly, the controller of the first aspect allows an axial piston pump having a fixed valve plate to be controlled as if it had an adjustable stiffness similar to an axial piston pump having a variable-position valve plate.

According to a second aspect of the disclosure an axial piston pump having a fixed valve plate and a variable displacement is provided. The axial piston pump comprises:

- a swash plate having a variable angle of inclination in order to define a displacement of the axial piston pump;
- a solenoid actuator connected to the swash plate, the solenoid actuator configured to control the angle of inclination of the swash plate in order to control the displacement of the axial piston pump; and an axial piston pump controller configured to:

determine a displacement of the axial piston pump;

calculate a pump displacement control current to be supplied to the solenoid actuator to control the displacement of the axial piston pump comprising:

calculating a nominal value for the pump displacement control current based on a rotational speed of the axial piston pump;

calculating a pump stiffness adjustment factor based on a control map having as inputs: an output pressure of the axial piston pump; and the estimated pump displacement; and calculating the pump displacement control current to be supplied to the solenoid actuator based on the nominal value and the pump stiffness adjustment factor; and output an instruction to output the calculated pump displacement control current to the solenoid actuator in order to control the displacement of the axial piston pump.

The axial piston pump of the second aspect has a fixed valve plate. The controller of the axial piston pump includes a control map which can be used calculate a pump stiffness adjustment factor in order to effectively the stiffness of the axial piston pump. Accordingly, the axial piston pump of the second aspect can be controlled as if it had an adjustable stiffness similar to an axial piston pump having a variable-position valve plate. In contrast to an axial piston pump with a variable-position valve plate, the axial piston pump of the second aspect has an adjustable stiffness that does not require any mechanical adjustment of the axial piston pump.

BRIEF DESCRIPTION OF THE FIGURES

A specific embodiment of the disclosure will now be described, by way of example only, with reference to the accompanying drawings in which.

DETAILED DESCRIPTION

Figure 3:
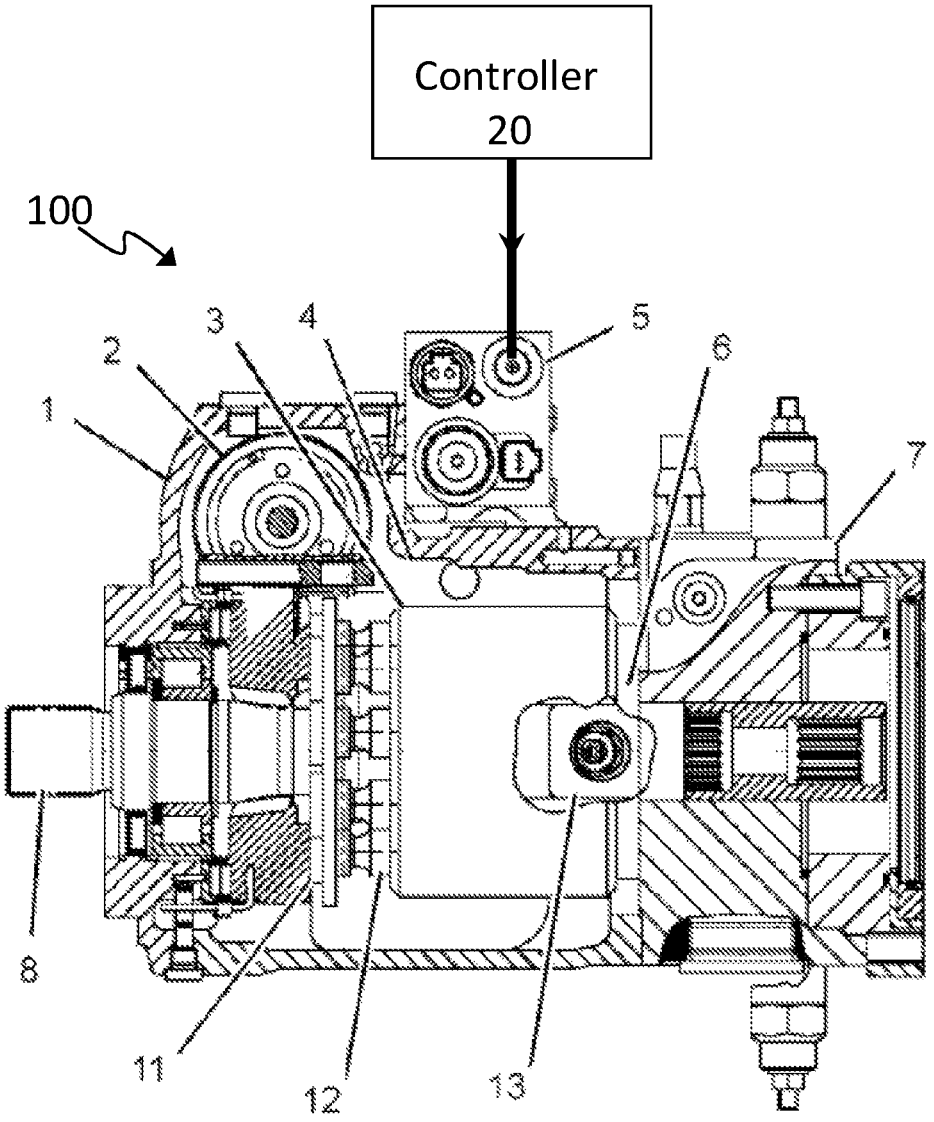
FIG. 3 is a schematic diagram of an axial piston pump according to an embodiment of the disclosure.

According to an embodiment of the disclosure, an axial piston pump is provided. A schematic diagram of the axial piston pump 100 is shown in FIG. 3. As shown in FIG. 3, the axial piston pump 100 comprises a housing 1, a servo piston 2, a piston barrel 3, a piston barrel housing 4, a pump control valve 5, a fixed valve plate 6, a pump head 7, a rotational shaft 8, and a swashplate 11, a plurality of pistons 12, and a controller.

The axial piston pump 100 shown in FIG. 3 may be a non-feedback axial piston pump. In this context, non-feedback refers to the absence of mechanical feedback which may be configured to mechanically feedback changes in the output pressure to the control of the axial piston pump displacement.

The axial piston pump 100 may be installed in a closed-loop hydraulic system. As such, the hydraulic fluid pumped through the axial piston pump 100 is pumped though a closed circuit (ignoring any hydraulic fluid losses or leakages from the closed loop) and essentially returns back to the axial piston pump 100.

The plurality of pistons 12 of the axial piston pump 100 are located in a circular array within the piston barrel 3. The pistons 12 may be spaced at equal intervals about the rotational shaft 8 which is located at a longitudinal centre of the piston barrel 3. The piston barrel 3 is compressed against the fixed valve plate 6 by a spring 13. The spring 13 is shown in a cut-away portion of FIG. 3.

Each piston 12 is connected to the swash plate 11 via a connector, typically a ball and socket joint. The swash plate 11 is moveable about a pivot point such that the angle of inclination of the swash plate 11 can be varied. In FIG. 3, the angle of inclination of the swashplate is 0° such that the axial piston pump has zero displacement. The angle of inclination of the swash plate 11 is controlled by the servo piston 2, as discussed further below.

Figure 1:
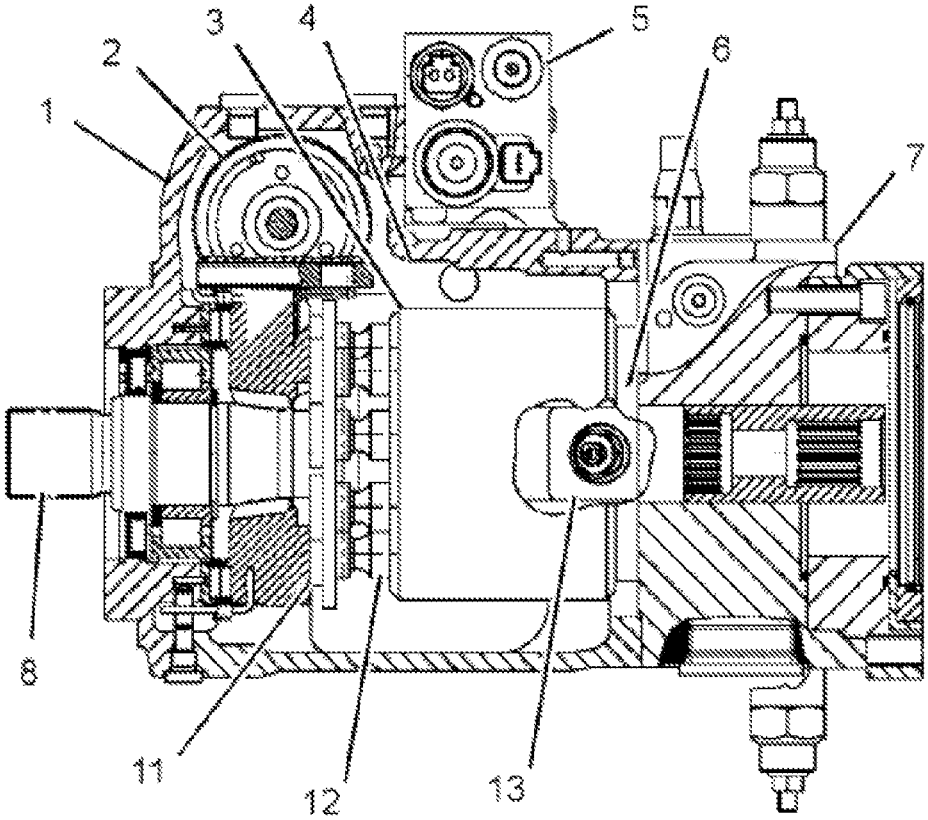
FIG. 1 is a schematic diagram of an axial piston pump known in the art.
Figure 2:
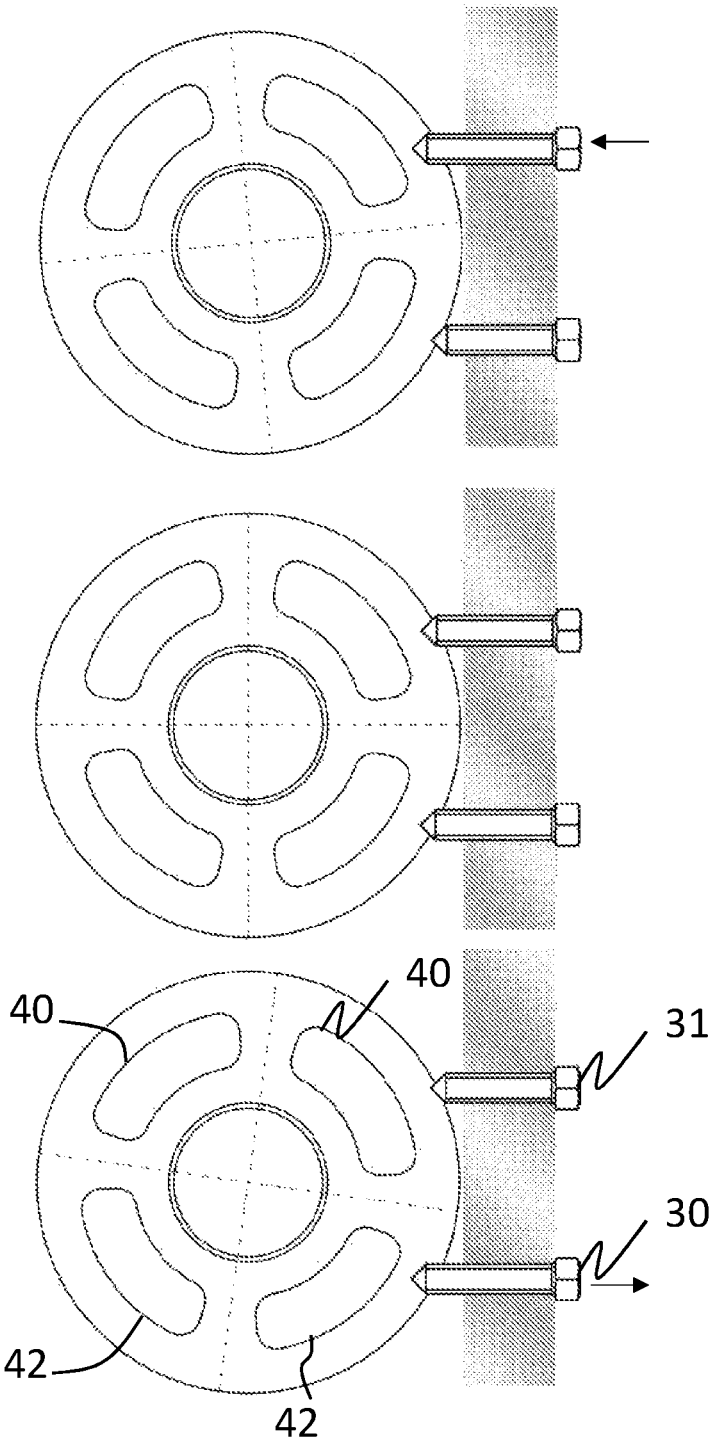
FIG. 2 is an explanatory diagram of a variable-position valve pate.

The fixed valve plate 6 comprises at least one arcuate inlet port (not shown) and at least one arcuate outlet port (not shown). For example, the fixed valve plate 6 may be provided with similar inlet and outlet ports to the valve plate shown in FIG. 2 (although the valve plate 6 of FIG. 3 does not include rotational adjustment features). The arcuate inlet port is configured to receive hydraulic fluid at a relatively low pressure. Hydraulic fluid is discharged from the pistons 12 at a relative high pressure through the arcuate outlet port.

During operation of the axial piston pump 100, the piston barrel 3 rotates so that each piston 12 periodically passes over the each of the arcuate inlet port and the arcuate outlet port of the fixed valve plate 6. The rotation of the piston barrel is driven by rotation of the rotation shaft 8, which in turn may be connected to a source of motive power. For example, in the embodiment of FIG. 3, the rotation shaft may be driven (rotated) by an internal combustion engine or an electric motor connected to a battery.

The angle of inclination of the swash plate 6 causes the pistons to undergo an oscillatory displacement in and out of the cylinder block, thus drawing the hydraulic fluid into the arcuate inlet port and subsequently expelling the hydraulic fluid out of the arcuate outlet port. The volume of hydraulic fluid expelled is related to the magnitude of the angle of inclination of the swash plate 6. For small angles of inclination, the stroke of each piston 12 is relatively small, and thus the volume of hydraulic fluid discharged is relatively low. As the angle of inclination increases, the piston stroke increases, thus increasing the volume of hydraulic fluid expelled.

The angle of inclination of the swash plate 11 is controlled by a servo piston 2. The servo piston 2 is configured to control the flow of hydraulic fluid for biasing the angle of inclination of the swash plate 11. The flow of hydraulic fluid is proportional to the degree the servo piston 2 is opened. As such, the angle of inclination of the swash plate 11 is controlled based on the degree of opening of the servo piston 2.

The degree of opening of the servo piston 2 is in turn controlled by pump control valve 5. Pump control valve 5 comprises a solenoid actuator (not shown). The solenoid actuator controls a pilot pressure which in turn is used to control the degree of opening of the servo piston 2. As such, a pump displacement control current supplied to the solenoid actuator of the pump control valve 5 controls the angle of inclination of the swash plate 11, and thus the displacement of the axial piston pump.

The skilled person will appreciate that electro-hydraulic actuators for controlling the position of a swash plate 11 are well known to the skilled person. Accordingly, the skilled person will appreciate that the present disclosure may be applied to any axial piston pump having an electro-hydraulic actuator configured to control the variable displacement of the axial piston pump 100.

The solenoid actuator of the pump control valve 5 is controlled by controller 20 which is configured to supply a pump displacement control current to the pump control valve 5. The controller 20 may be a dedicated processor configured to perform the control scheme discussed below. In some embodiments, the controller 20 of this disclosure may be combined with other control functions. For example, an engine control unit (ECU) of a hydraulic machine may be used to provide the controller 20 according to this disclosure. As such, the controller 20 may be provided separately (i.e. not directly mounted on or incorporated into) from the axial piston pump 100.

Figure 4:
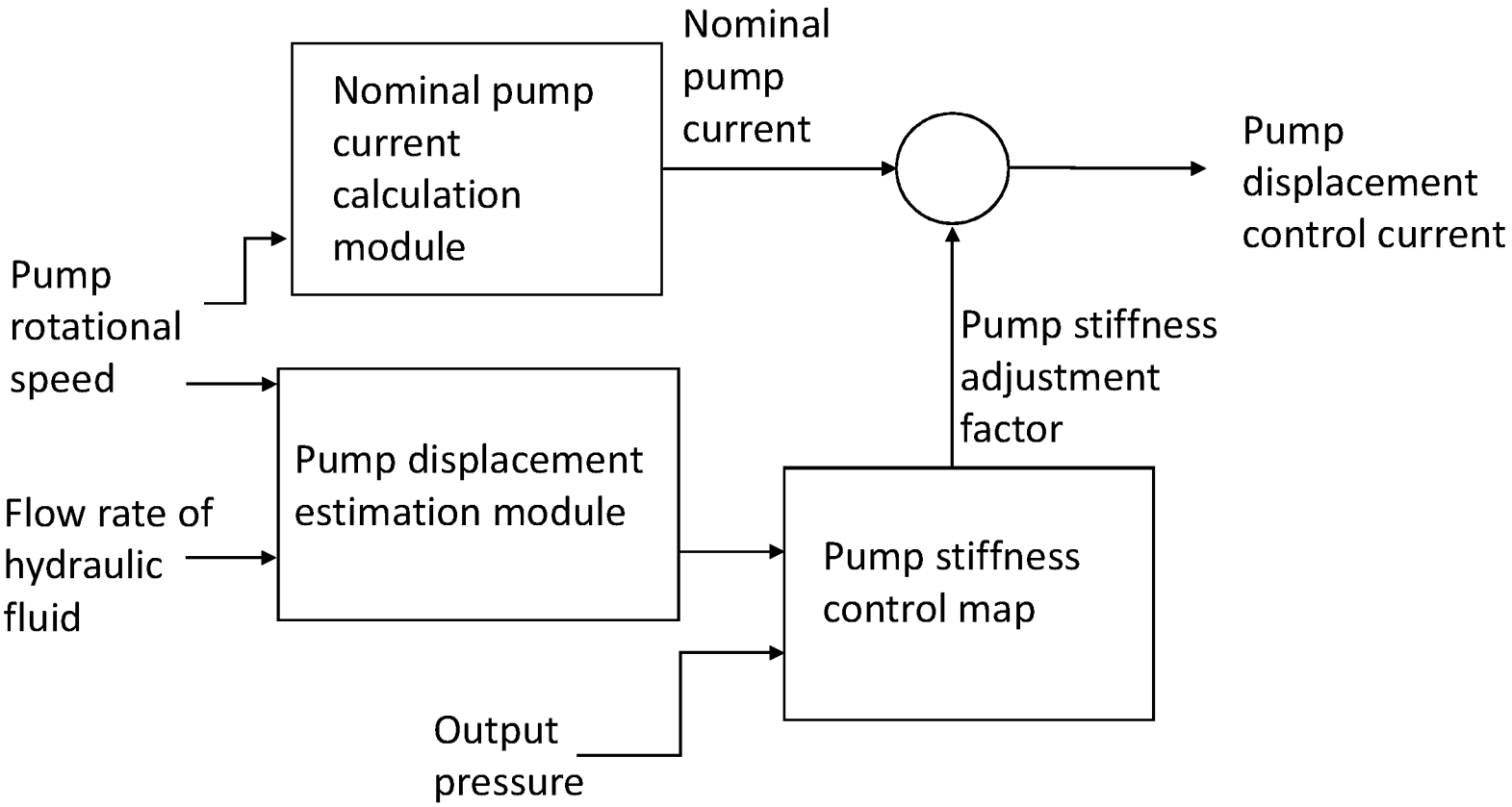
FIG. 4 is a block diagram of an axial piston pump controller according to an embodiment of the disclosure.

FIG. 4 shows a block diagram of a controller 20 according to an embodiment of the disclosure. As shown in FIG. 4, the controller comprises a nominal current calculation module 110 that is configured to calculate a nominal pump current. The nominal pump current is calculated based on the pump rotational speed (i.e. the rotational speed of the rotation shaft 8). In some embodiments, the controller may obtain this value, or a value representative of this value from the source of motive power that is connected to the rotation shaft 8. For example, in some embodiments, the controller 20 may determine the pump rotational speed from the engine speed of an internal combustion engine that is driving the rotation shaft 8. In some embodiments, the pump rotational speed may be in the range of about 1000 revolutions per minute (rpm) to about 2000 rpm.

In some axial piston pumps known in the art, the pump displacement control current provided to the axial piston pump is, essentially, the nominal pump current. That is to say, it is known in the art to calculate the pump displacement control current based on the pump rotational speed driving the pump. This calculation is typically performed using a one dimensional control map which provides a nominal pump current for different pump rotational speeds.

The controller according to the embodiment of FIG. 4 also calculates a pump stiffness adjustment factor. The pump stiffness adjustment factor, in combination with the nominal pump current value, is used by the controller to calculate the pump displacement control current. As such, the controller 20 according to the embodiment of FIG. 4 utilises further information of the operation of the axial piston pump in order to adjust the pump displacement control current provided to the axial piston pump. Specifically, the pump stiffness adjustment factor provides a means for the controller to effectively change the stiffness of the axial piston pump in response to a change in the displacement or pressure of the axial piston pump whilst operating at a constant engine speed.

Figure 5:
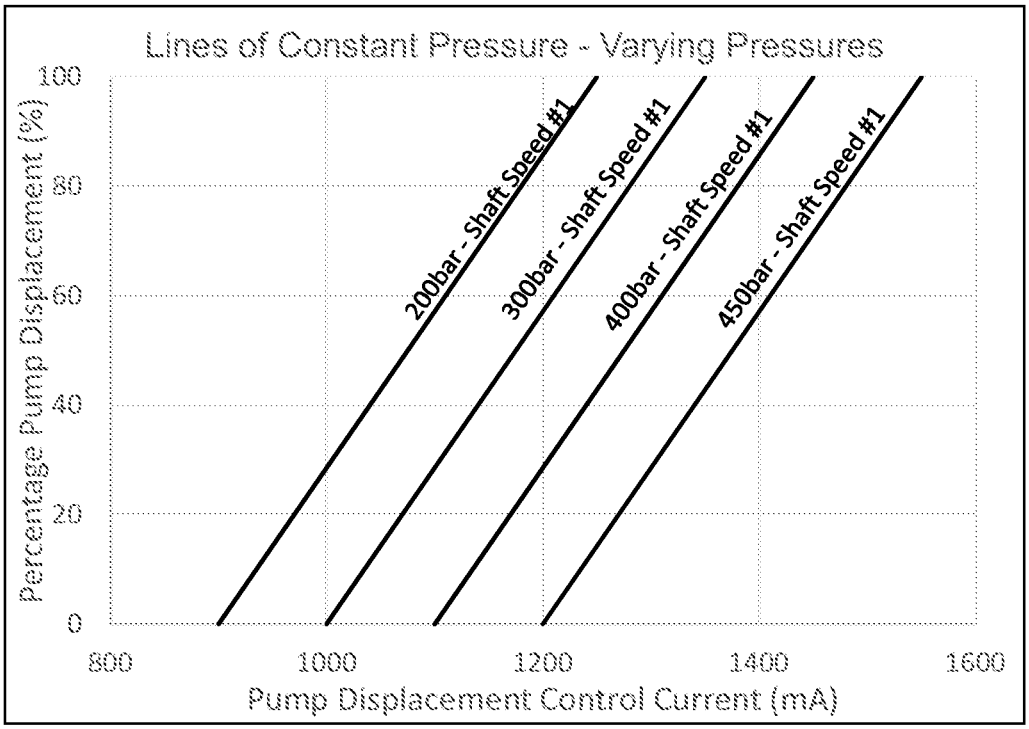
FIG. 5 is a graph showing the variable between the pump displacement control current and the variable displacement for different lines of constant pressure.

FIG. 5 shows a graph of which shows the relationship between the pump displacement control current and the resulting percentage pump displacement of the axial piston pump (wherein 0% pump displacement is a swash plate angle of inclination of 0° and 100% pump displacement is the maximum angle of inclination). As shown in FIG. 5, a plurality of lines are shown representing the relationship at different constant pump output pressures under a constant pump rotational speed (e.g. 1000 rpm).

It will be appreciated from FIG. 5 that for axial piston pumps operating with a pump displacement control current controlled based only on pump rotational speed, the displacement of the pump will vary depending on the output pressure of the axial piston pump. For example, for a pump displacement current of 1200 mA and a pump output pressure of 200 bar, the axial piston pump will have a displacement of about 87%. In the event that the output pressure of the axial piston pump increases to about 300 bar with no change in pump rotational speed and thus no change in pump displacement current, the axial piston pump would destroke itself to a displacement of about 57%.

According to the embodiment of FIG. 4, the pump stiffness adjustment control map provides a pump stiffness adjustment factor which effectively increases the stiffness of the pump in response to such a change in pressure for a fixed engine speed. That is to say, the pump stiffness adjustment factor can increase the pump displacement control current in response to an increase in system pressure to try to reduce or prevent the pump from destroking in response to an increase in output pressure.

As shown in FIG. 4, the pump stiffness control map has inputs: output pressure and pump displacement. The output pressure of the axial piston pump may be measured using a pressure sensor located at, or proximal to, arcuate outlet port of the axial piston pump. The pump displacement may, in some embodiments, be measured using a dedicated sensor (e.g. a sensor configured to determine the angle of inclination of the swashplate), or may be estimated using a pump displacement estimation module as shown in the embodiment of FIG. 4. As such, the controller of FIG. 4 is configured to adjust the nominal pump current based on the pump stiffness adjustment factor in order to determine the pump displacement control current to be provided to the axial piston pump.

In the embodiment of FIG. 4, the displacement of the pump (percentage displacement) is estimated using the pump displacement estimation module. The pump displacement estimation module may be configured to estimate the pump displacement based on a relationship between the hydraulic fluid volume output by the axial piston pump and the output of a motor driven by the axial piston pump.

In such a case, the pump displacement ($D_P$), pump rotational speed ($S_P$), motor rotational speed ($S_M$) and motor displacement ($D_M$) are related by the following equation:

$$D_P S_P = D_M S_M$$

The motor rotational speed $S_M$ can be measured using a suitable sensor, the output of which is provided to the controller 20. The pump rotational speed $S_P$ may also be measured and provided to the controller 20. The motor displacement can be inferred from the motor speed based on a calibration of the motor at a range of different motor speeds. As such, a control map for estimating the pump displacement can be generated having as inputs: motor rotational speed and pump rotational speed which allows the pump displacement to be estimated. The estimated pump displacement can then be provided to the pump stiffness control map in order to determine the pump stiffness adjustment factor.

Figure 6:
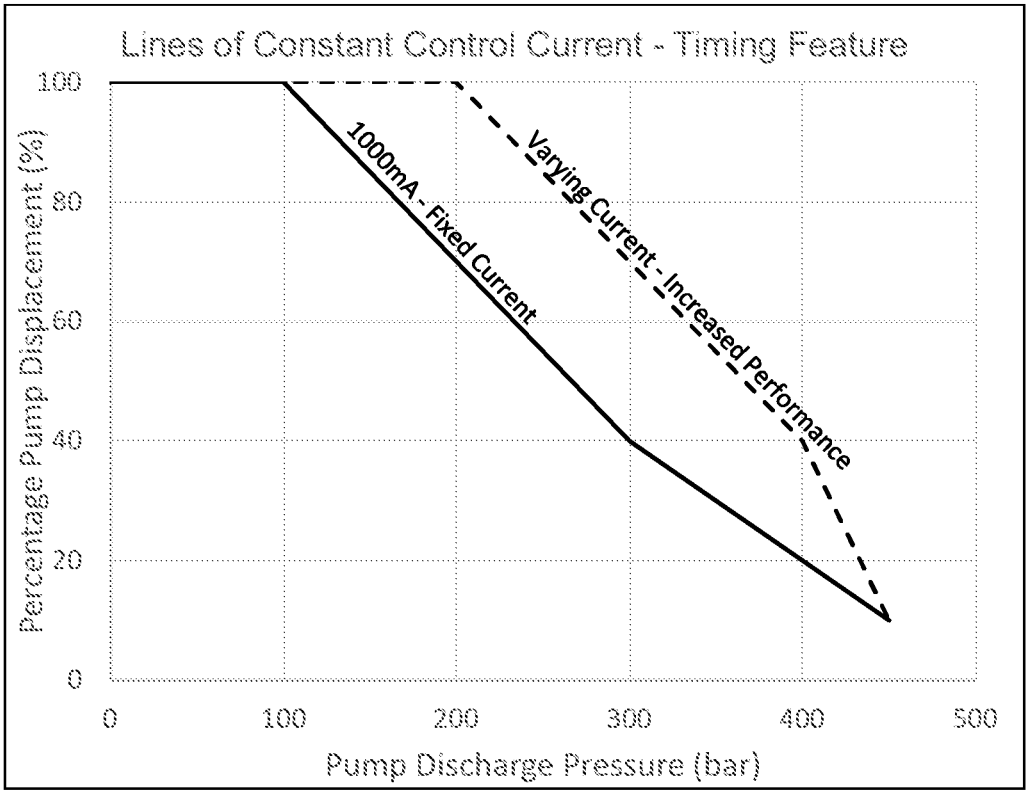
FIG. 6 is a graph showing the effect of the pump stiffness adjustment factor on pump performance relative to a pump having a fixed displacement control current

A graph showing the effect of the pump stiffness adjustment factor is shown in FIG. 6. The solid black line in FIG. 6 shows the relationship between the pump output pressure and the percentage pump displacement were the axial piston pump to be controlled based on the nominal current only (i.e. a fixed current of 1000 mA) when operating at a constant pump rotational speed. As shown in FIG. 6, once the pump output pressure exceeds about 100 bar, the force of the output pressure on the swashplate 11 causes the axial piston pump to destroke, reducing the percentage pump displacement.

The dashed line in FIG. 6 shows the effect of the pump stiffness adjustment factor on the resulting percentage pump displacement. As the output pressure increases above 100 bar, the pump stiffness adjustment factor can act to increase the amount of pump displacement current supplied to the axial piston pump, effectively increasing the stiffness of the swash plate in order to prevent the pump from destroking.

Figures 7, 8, 9:
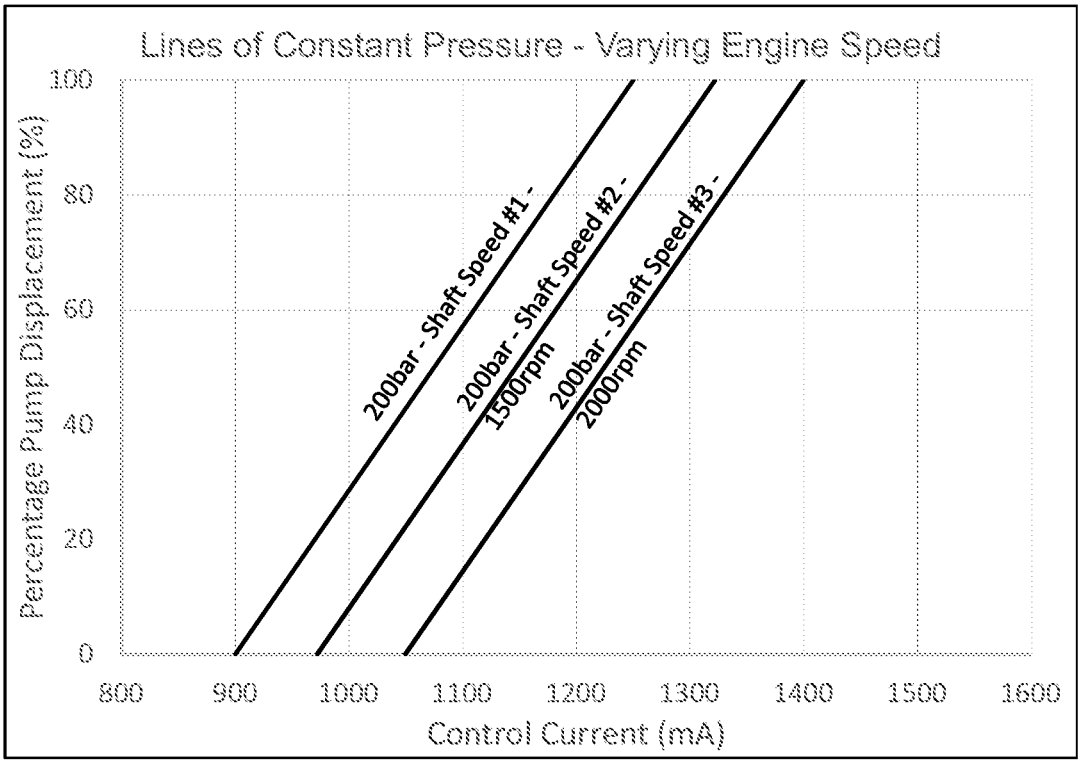
FIG. 7 is an example displacement control map showing example values for the pump stiffness adjustment factor.
FIG. 8 is a further example displacement control map showing example values for the pump stiffness adjustment factor at a higher rotational speed of the axial pump.
FIG. 9 is a graph showing the relationship between the pump displacement control current and the variable displacement for at a pressure of 200 bar at different engine speeds.

An example of a pump stiffness control map is shown in FIG. 7.

In some embodiments, a single pump stiffness control map may be provided separately from the calculation of the nominal pump current based on the engine speed. As such, the pump stiffness adjustment to the pump displacement control current may be applied independently of the pump rotation speed. In some embodiments, the pump stiffness adjustment to the pump displacement current may also be dependent on pump rotation speed. As such, in some embodiments, a plurality of pump stiffness control maps may be provided. Each of the plurality of pump stiffness control maps may provide a map of values for the pump stiffness adjustment factor at a respective pump rotation speed. The controller 20 may be configured to select one of the pump stiffness control maps for calculating the pump stiffness adjustment factor based on the engine speed.

FIG. 8 shows an example of a further pump stiffness control map for a pump rotational speed of 1500 rpm. As such, the pump stiffness control map of FIG. 7 (which is provided for a pump rotational speed of 1000 rpm) and the pump stiffness control map of FIG. 8 may form a plurality of pump stiffness control maps. In other embodiments, at least three, five, or seven pump stiffness control maps may be provided across a range of operation pump rotational speeds. It will be appreciated that where any of the inputs: pump rotational speed, pump output pressure, or pump displacement percentage falls between values shown in the control maps, the controller may select the nearest value for use, or may use interpolation between the nearest points on the control map in order to calculate the pump stiffness adjustment factor.

FIG. 9 shows a graph of the variation in the relationship between pump displacement control current and pump displacement at 200 bar for different pump rotational speeds.

While the embodiment of FIG. 4 shows separate calculations for the nominal pump current and the pump adjustment factor, in some embodiments where the input to the plurality of pump displacement control maps includes the pump rotational speed, the calculation of the nominal pump current may be combined with the calculation of the pump stiffness adjustment factor in the pump stiffness control map.

Figure 10:
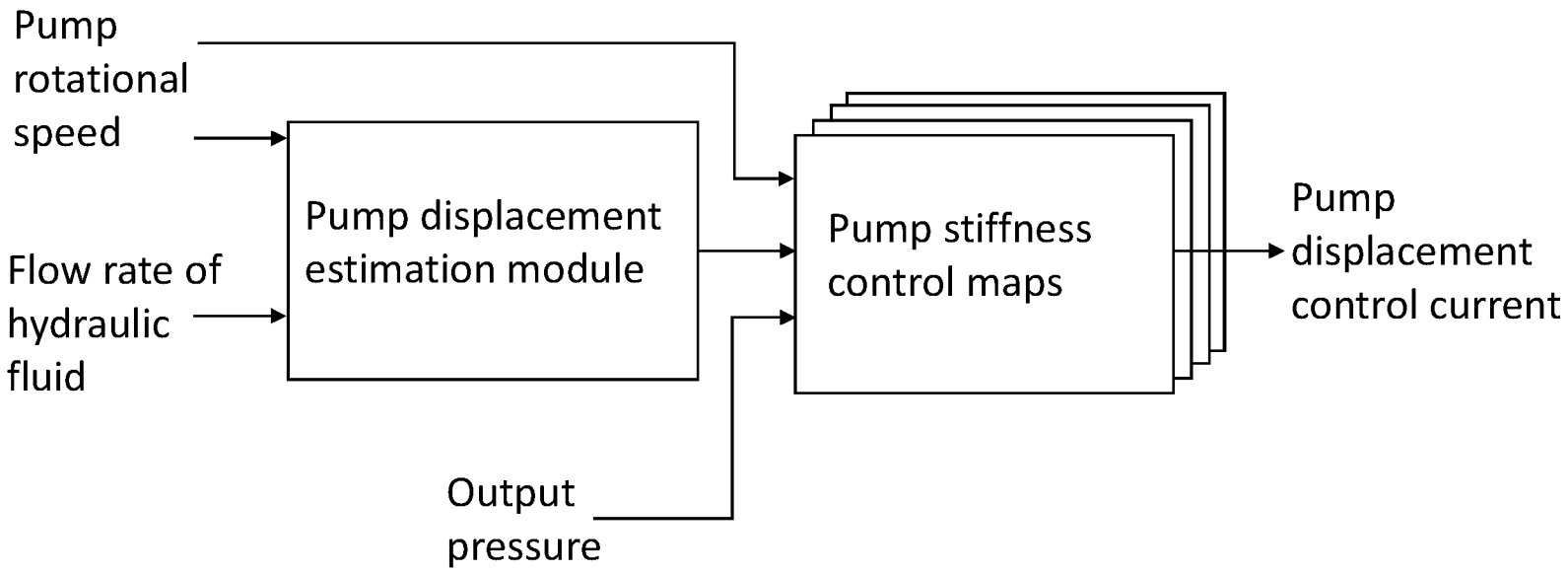
FIG. 10 is a block diagram of an axial piston pump controller according to a further embodiment of the disclosure.

FIG. 10 shows a block diagram of a controller 20 according to another embodiment of the disclosure. As shown in FIG. 10, the pump rotational speed is used to select one of the plurality of control maps for use by the controller. Each pump rotational stiffness control map comprises values for the pump adjustment factor pre-combined with the nominal current value based on the pump rotational speed associated with the respective pump stiffness control map. As such, each pump stiffness control map is configured to directly output the pump displacement current to be output to the axial piston pump 100.

Thus, according to this disclosure, the controller 20 may be configured to perform a method of controlling a displacement of an axial piston pump having a fixed valve plate and a variable displacement. In a first step of the method, a displacement of the axial piston pump is determined. As discussed above, the displacement may be determined by estimation using the pump displacement estimation module or by direct measurement using a suitable sensor.

A pump displacement control current to be supplied to the axial piston pump to control the displacement of the axial piston pump is also calculated. This step comprises calculating a nominal value for the pump displacement control current based on a rotational speed of the axial piston pump and calculating a pump stiffness adjustment factor based on a pump stiffness control map having as inputs: an output pressure of the axial piston pump; and the estimated pump displacement. The pump displacement control current to be supplied to the axial piston pump is then calculated based on the nominal value and the pump stiffness adjustment factor.

Once calculated, the controller 20 outputs an instruction to output the calculated pump displacement control current to the axial piston pump in order to control the displacement of the axial piston pump.

Thus, according to embodiments of this disclosure a controller 20 for controlling the displacement of an axial piston pump 100 is provided.

INDUSTRIAL APPLICABILITY

According to this disclosure, an axial piston pump controller is provided. The axial piston pump controller may be used to control an axial piston pump. The axial piston pump may be installed in a closed-loop hydraulic system. For example, the axial piston pump may be provided as part of a hydraulic system for a machine (i.e. a hydraulic machine).

What is claimed is:

1. An axial piston pump controller for an axial piston pump having a fixed valve plate and a variable displacement configured to:

determine a displacement of the axial piston pump;

calculate a pump displacement control current to be supplied to the axial piston pump to control the displacement of the axial piston pump comprising:

calculating a nominal value for the pump displacement control current based on a rotational speed of the axial piston pump;

calculating a pump stiffness adjustment factor based on a pump stiffness control map having as inputs: an output pressure of the axial piston pump; and the estimated pump displacement; and calculating the pump displacement control current to be supplied to the axial piston pump based on the nominal value and the pump stiffness adjustment factor; and output an instruction to output the calculated pump displacement control current to the axial piston pump in order to control the displacement of the axial piston pump.

2. An axial piston pump controller according to claim 1, wherein the axial piston pump to be controlled comprises a control cylinder connected to the swash plate and configured to control the angle of inclination of the swash plate; and a valve configured to control a flow of hydraulic fluid to the control cylinder, wherein a position of the valve is controlled by a solenoid actuator, wherein the pump displacement control current calculated by the controller is output to the solenoid actuator.

3. An axial piston pump controller according to claim 1, wherein in order to determine the displacement of the axial piston pump, the controller is configured to:

calculate an estimated displacement based on a displacement estimation control map having as inputs: the rotational speed of the axial piston pump and a variable representative of a flow rate of hydraulic fluid to the control cylinder.

4. An axial piston pump controller according to claim 1, wherein a plurality of pump stiffness control maps are provided, each of the plurality of pump stiffness control maps corresponding to a different rotational speed of the axial piston pump, wherein the controller is configured to select one of the plurality of pump stiffness control maps to calculate the pump stiffness adjustment factor based on the rotational speed of the axial piston pump.

5. An axial piston pump according to claim 4, wherein each of the plurality of pump stiffness control maps defines a different relationship between the inputs: output pressure of the axial piston pump and the estimated pump displacement, and the output pump stiffness adjustment factor.

6. An axial piston pump controller according to claim 4, wherein each of the plurality of pump stiffness control maps incorporates the nominal value for the pump displacement control current based on the rotational speed for the respective pump stiffness control map into the output of the respective pump displacement control map.

7. An axial piston pump having a fixed valve plate and a variable displacement comprising:

a swash plate having a variable angle of inclination in order to define a displacement of the axial piston pump;

a solenoid actuator connected to the swash plate, the solenoid actuator configured to control the angle of inclination of the swash plate in order to control the displacement of the axial piston pump; and an axial piston pump controller configured to:

determine a displacement of the axial piston pump;

calculate a pump displacement control current to be supplied to the solenoid actuator to control the displacement of the axial piston pump comprising:

calculating a nominal value for the pump displacement control current based on a rotational speed of the axial piston pump;

calculating a pump stiffness adjustment factor based on a control map having as inputs: an output pressure of the axial piston pump; and the estimated pump displacement; and calculating the pump displacement control current to be supplied to the solenoid actuator based on the nominal value and the pump stiffness adjustment factor; and output an instruction to output the calculated pump displacement control current to the solenoid actuator in order to control the displacement of the axial piston pump.

8. An axial piston pump according to claim 7, further comprising:

a control cylinder connected to the swash plate and configured to control the angle of inclination of the swash plate; and a valve configured to control a low of hydraulic fluid to the control cylinder, wherein a position of the valve is controlled by the solenoid actuator.

9. An axial piston pump according to claim 7, wherein in order to determine the displacement of the axial piston pump, the controller is configured to:

calculate an estimated displacement based on a displacement estimation control map having as inputs: the rotational speed of the axial piston pump and a variable representative of a flow rate of hydraulic fluid to control cylinder.

10. An axial piston pump according to claim 7, wherein a plurality of pump stiffness control maps are provided, each of the plurality of pump stiffness control maps corresponding to a different rotational speed of the axial piston pump, wherein the controller is configured to select one of the plurality of pump stiffness control maps to calculate the pump stiffness adjustment factor based on the rotational speed of the axial piston pump.

11. An axial piston pump according to claim 10, wherein each of the plurality of pump stiffness control maps defines a different relationship between the inputs: output pressure of the axial piston pump and the estimated pump displacement, and the output pump stiffness adjustment factor.

12. An axial piston pump controller according to claim 10, wherein each of the plurality of pump stiffness control maps incorporates the nominal value for the pump displacement control current based on the rotational speed for the respective pump stiffness control map into the output of the respective pump displacement control map.

13. A method of controlling a displacement of an axial piston pump having a fixed valve plate and a variable displacement comprising:

estimating a displacement of the axial piston pump;

calculating a pump displacement control current to be supplied to the axial piston pump to control the displacement of the axial piston pump comprising:

calculating a nominal value for the pump displacement control current based on a rotational speed of the axial piston pump;

calculating a pump stiffness adjustment factor based on a pump stiffness control map having as inputs: an output pressure of the axial piston pump; and the estimated pump displacement; and calculating the pump displacement control current to be supplied to the axial piston pump based on the nominal value and the pump stiffness adjustment factor; and outputting an instruction to output the calculated pump displacement control current to the axial piston pump in order to control the displacement of the axial piston pump.

14. A method according to claim 13, wherein a plurality of pump stiffness control maps are provided, each of the plurality of pump stiffness control maps corresponding to a different rotational speed of the axial piston pump, wherein the controller is configured to select one of the plurality of pump stiffness control maps to calculate the pump stiffness adjustment factor based on the rotational speed of the axial piston pump.

15. A method according to claim 14, wherein each of the plurality of pump stiffness control maps defines a different relationship between the inputs: output pressure of the axial piston pump and the estimated pump displacement, and the output pump stiffness adjustment factor.

* * * * *